US007775383B2

(12) United States Patent
Ueki et al.

(10) Patent No.: US 7,775,383 B2
(45) **Date of Patent: *Aug. 17, 2010**

(54) HOISTING DEVICE WITH VERTICAL MOTION COMPENSATION FUNCTION

(75) Inventors: Shuji Ueki, Tokyo (JP); Hirohumi Doi, Tamano (JP); Shogo Miyajima, Tokyo (JP); Kenzo Hasegawa, Yokohama (JP); Hiroshi Satoh, Fujisawa (JP)

(73) Assignees: Mitsui Engineering & Shipbuilding Co., Ltd., Tokyo (JP); Tsurumi Seiki Co., Ltd., Yokohama (JP); Dai-Ichi Electric Co., Ltd., Fujisawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/318,490

(22) Filed: Dec. 30, 2008

(65) Prior Publication Data

US 2009/0166309 A1 Jul. 2, 2009

Related U.S. Application Data

(62) Division of application No. 11/107,932, filed on Apr. 18, 2005, now Pat. No. 7,681,748.

(51) Int. Cl.
*B66C 23/53* (2006.01)

(52) U.S. Cl. ..... 212/308; 212/270; 254/900

(58) Field of Classification Search ..... 212/308, 212/270; 254/900

See application file for complete search history.

(56) References Cited

U.S. PATENT DOCUMENTS 3,753,552 A * 8/1973 Barron ..... 254/270
4,114,827 A 9/1978 Maier (Continued)

FOREIGN PATENT DOCUMENTS

JP A-40-023877 8/1965

(Continued)

OTHER PUBLICATIONS

"Fuke No Kagaku," vol. 52, No. 12, pp. 52-55, (1999).

*Primary Examiner*—Thomas J. Brahan
(74) *Attorney, Agent, or Firm*—Oliff & Berridge, PLC

(57) ABSTRACT

A hoisting device can be small-sized and energy can be saved. A hoisting device 10 according to the present invention has a hoist 30 and a control unit 32. The hoist 30 rotates a drum 12 having a wire 14 wound thereon by an oil pressure motor 42 rotatable in normal and reverse directions. To the oil pressure motor 42, operating oil is supplied from an oil pressure pump 44. The oil pressure pump 44 is a two-way discharge fixed capacity type, and rotated by a servomotor 46. An acceleration/displacement transducer 34 in the control unit 32 finds a moving direction and a moving speed of a wire hanging point in the vertical direction from an output signal of an acceleration sensor 24. The control unit 32 outputs a drive control signal of the servomotor 46 according to a paying-out speed or a rolling-up speed of the wire 14 offsetting the vertical motion of the wire hanging point caused by the heaving of a hull based on a speed instruction Vi of the paying-out or rolling-up speed of the wire, a detected signal of the acceleration sensor 24 and a detected signal of a wire speed sensor 26.

11 Claims, 4 Drawing Sheets

U.S. PATENT DOCUMENTS

| | | | | |
|---|---|---|---|---|
| 4,448,396 | A | 5/1984 | Delago | |
| 4,547,857 | A * | 10/1985 | Alexander | 700/275 |
| 4,932,541 | A | 6/1990 | Belsterling | |
| 7,681,748 | B2 * | 3/2010 | Ueki et al. | 212/308 |

FOREIGN PATENT DOCUMENTS

| | | |
|---|---|---|
| JP | S53-16292 | 2/1978 |
| JP | B2-60-028807 | 6/1985 |
| JP | A-62-07772 | 4/1987 |
| JP | A-63-023002 | 1/1988 |
| JP | A-02-300096 | 12/1990 |
| JP | A-04-191296 | 7/1992 |
| JP | A-07-133093 | 5/1995 |
| JP | A-08-016247 | 1/1996 |

* cited by examiner

HOISTING DEVICE WITH VERTICAL MOTION COMPENSATION FUNCTION

This is a Division of application Ser. No. 11/107,932 filed Apr. 18, 2005. The disclosure of the prior application is hereby incorporated by reference herein in its entirety.

BACKGROUND OF THE INVENTION

1. Field of the Invention

This invention relates to a hoisting device with a vertical motion compensation function, especially the hoisting device with the vertical motion compensation function eliminating effects by the heaving of a ship caused by waves with respect to an article hung from the ship through a wire.

2. Description of the Related Art

In the prevailing oceanographic observation, the sea area is grasped three-dimensionally based on the data of a vertical distribution and a horizontal distribution of a salinity concentration, a water temperature and a water depth measured at the same time. There is a CTD (conductivity temperature depth) observation instrument as an instrument for gathering the above data. The observation instrument is used for observing the CTD under a situation maintained in a constant depth, hung by a winch from a board of a ship to the sea. There is a case that measurements are performed, allowing the observation instrument to be raised or to be lowered at a constant speed. Furthermore, there are cases, for example, such that works are performed with a work robot held in a constant depth of the sea, and such that structures or the topography of the sea floor are observed with a camera hung from a board of a ship held in a constant depth by using a lifting device on the ship.

In such cases, when a hull is moved vertically by waves, an equipment such as the observation instrument in the water is also moved vertically in accordance with the vertical motion of the hull, as a result, accurate and speedy observations or works can not be performed. Therefore, it is required that the observation instrument or the equipment hung from the hull is allowed to be held in a constant depth or to be raised or lowered at a constant speed, and patent document 1 disclose a heaving-compensation type crane for the purpose.

FIG. 4 is a schematic view of a heaving-compensation type crane according to patent document 1. As shown in FIG. 4, in a crane system 2 installed on a hull 1, a wire 5 is payed out from a winch 3 through a crane boom 4, and an observation instrument 6 is hung at a tip of the wire 5. An accelerometer 7 is installed at a tip portion of the crane boom 4. The accelerometer 7 detects a vertical motion of the tip portion of the crane boom 4 caused by a vertical motion of the hull 1, and an output signal thereof is fed to a cylinder control unit of the crane system 2 not shown. Accordingly, when the hull 1 is moved vertically (heaving) by waves, the cylinder control unit offsets a vertical motion of the tip portion of the crane boom 4 by allowing a rod of a cylinder 8 to expand and contract to maintain the observation instrument 6 in the sea hung by the wire 5 in a constant depth.

However, the above crane system 2 has the following problems. Since the crane boom 4 composing the aforementioned crane system 2 is a large-sized heavy object, a large-sized cylinder is needed for allowing the crane boom 4 to move vertically and large energy is consumed, which increases costs. And further, because the crane boom 4 is the large-sized heavy object, it is difficult to move it vertically at high speed in accordance with the vertical motion caused by waves, as a result, the crane boom can not sufficiently follow up the vertical motion of the hull, which leads to a poor response.

Additionally, in a data observation by the CTD observation instrument, there is the case that a measurement is performed, allowing the instrument to be raised or to be lowered at a constant speed. The heaving-compensation type crane according to patent document 1 is not responsive to lift up or to lift down a lifting load at a constant speed when the full moves vertically by waves.

SUMMARY OF THE INVENTION

An object of the present invention is to save driving energy for performing a compensation operation caused by a vertical motion of a ship by reducing the size of a hoisting device of an underwater observation instrument to solve aforementioned problems.

The present invention has another object that the response with respect to offsetting the vertical motion of the underwater observation instrument caused by the heaving of a ship.

A hoisting device with a vertical motion compensation function according to the present invention includes a hydraulic motor rotating a drum having a wire wound thereon, which can rotate in normal and reverse directions, a hydraulic pump directly connected, and supplying operating oil to the hydraulic motor, an electric motor rotationally driving the hydraulic pump, a vertical motion sensor detecting a vertical motion of a hanging point of the wire payed out and hung from the drum, and a control unit paying out or rolling up the wire by controlling a discharge amount of the hydraulic pump based on a detected signal of the vertical motion sensor, eliminating the effects of the vertical motion of the hanging point operating on the wire.

The control unit controls the discharge amount of the hydraulic pump based on the detected signal of the vertical motion sensor to maintain a given paying-out speed or a rolling-up speed of the wire.

A hoisting device with a vertical motion compensation function according to the present invention includes a hydraulic motor rotating a drum having a wire wound thereon, which can rotate in normal and reverse directions, a two-way discharge fixed capacity type pump supplying operating oil to the hydraulic motor, a servomotor rotationally driving the two-way discharge fixed capacity type pump, which can rotate in normal and reverse directions, a vertical motion sensor detecting a vertical motion of a hanging point of the wire payed out and hung from the drum, and a control unit paying out or rolling up the wire by controlling a discharge amount and a discharge direction of operating oil of the two-way discharge fixed capacity type pump through the servomotor based on a detected signal of the vertical motion sensor, eliminating the effects of the vertical motion of the hanging point operating on the wire.

The control unit controls the discharge amount of the two-way discharge fixed capacity type pump based on the detected signal of the vertical motion sensor to maintain a given paying-out speed or a rolling-up speed of the wire.

A hoisting device with a vertical motion compensation function according to the present invention includes a hydraulic motor rotating a drum having a wire wound thereon, which can rotate in normal and reverse directions, a two-way discharge variable capacity type pump supplying operating oil to the hydraulic motor, an electric motor rotationally driving the two-way discharge variable capacity type pump, a vertical motion sensor detecting a vertical motion of a hanging point of the wire payed out and hung from the drum, and a control unit paying out and rolling up the wire by controlling a discharge amount and a discharge direction of operating oil of the two-way discharge variable capacity type pump based on an detected signal of the vertical motion sensor, eliminating the effects of the vertical motion of the hanging point operating on the wire.

The control unit controls the discharge amount of the two-way discharge variable capacity type pump based on the detected signal of the vertical motion sensor to maintain a given paying-out speed or a rolling-up speed of the wire.

The two-way discharge variable capacity type pump controls the discharge amount of the operating oil by an inclination direction and an inclination angle of a swash plate.

A hoisting device with a vertical motion compensation function according to the present invention includes a hydraulic motor rotating a drum having a wire wound thereon, which can rotate in normal and reverse directions, a hydraulic pump directly connected to, and supplying operating oil to the hydraulic motor, and a branch oil passage supplying the operating oil to a closed circuit, in which one discharge port of the hydraulic pump is directly connected to one flow-in port of the hydraulic motor, and the other discharge port of the hydraulic pump is directly connected to the other flow-in port of the hydraulic motor.

The present invention thus constructed, the wire is payed out or rolled up by controlling the discharge amount of the operating oil of the hydraulic pump to eliminate the effects of the vertical motion of the wire hanging point. Therefore, a crane boom or the like as a large-sized heavy object is not required to be moved vertically, as a result, the whole hoisting device can be small-sized. In addition, the consumption energy of the hoisting device can be saved. Furthermore, since the wire is payed out or rolled up without moving the large-sized structure in the present invention, the wire can be payed out or rolled up, following the vertical motion of the hanging point of the wire easily, resultingly, the response can be improved. Therefore, the observation instrument or the equipment hung by the wire can be maintained at a constant depth with a high degree of accuracy, and the CTD measurement or works in a constant depth can be performed accurately and rapidly.

In the present invention, the given paying-out speed and rolling-up speed of the wire is maintained by controlling the discharge amount of the hydraulic pump. Therefore, the observation instrument and the like can be lifted up or lifted down at a constant speed regardless of the vertical motion of the ship (heaving). In addition, the CTD measurement in a depth direction can be performed accurately and rapidly.

DESCRIPTION OF THE PREFERRED EMBODIMENTS

Some embodiments of a hoisting device with a vertical motion compensation function according to the present invention will be described in detail with reference to the accompanying drawings.

Figure 1:
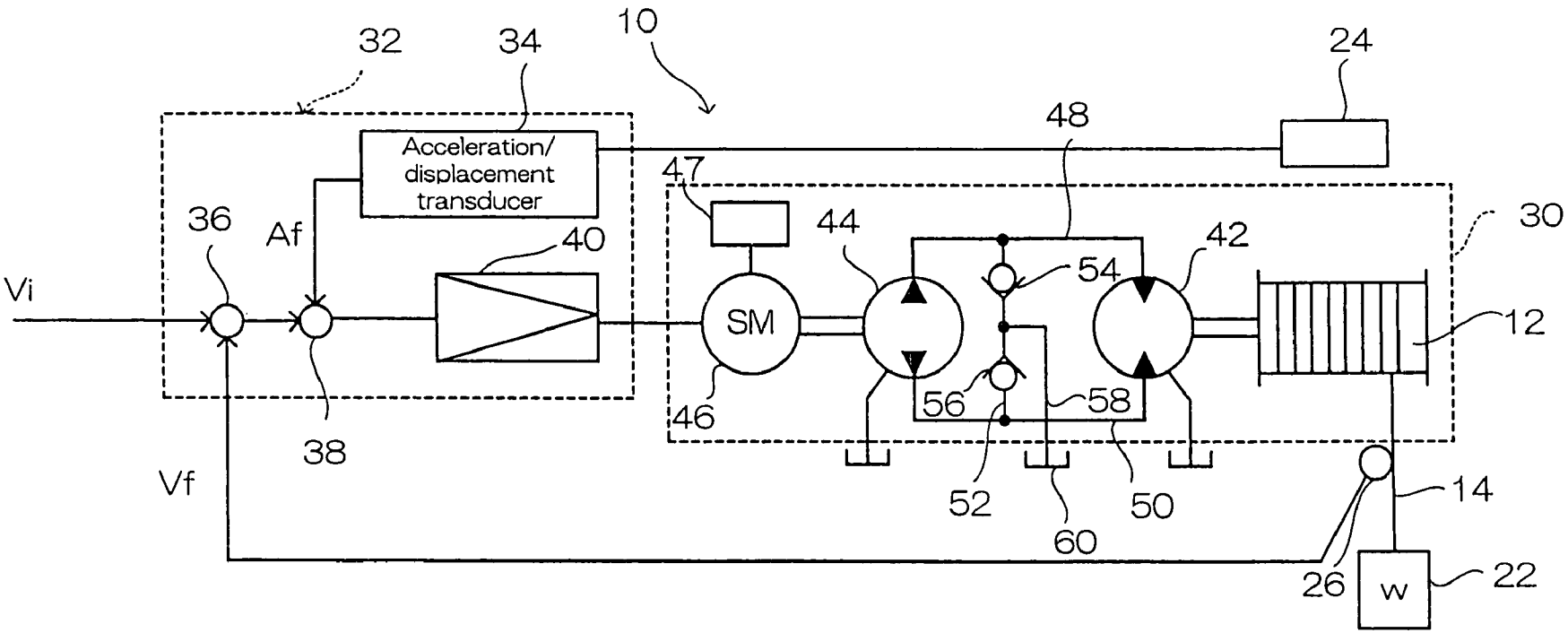
FIG. 1 is a detailed explanatory diagram of a hoisting device with a vertical motion compensation function according to a first embodiment of the present invention.
Figure 2:
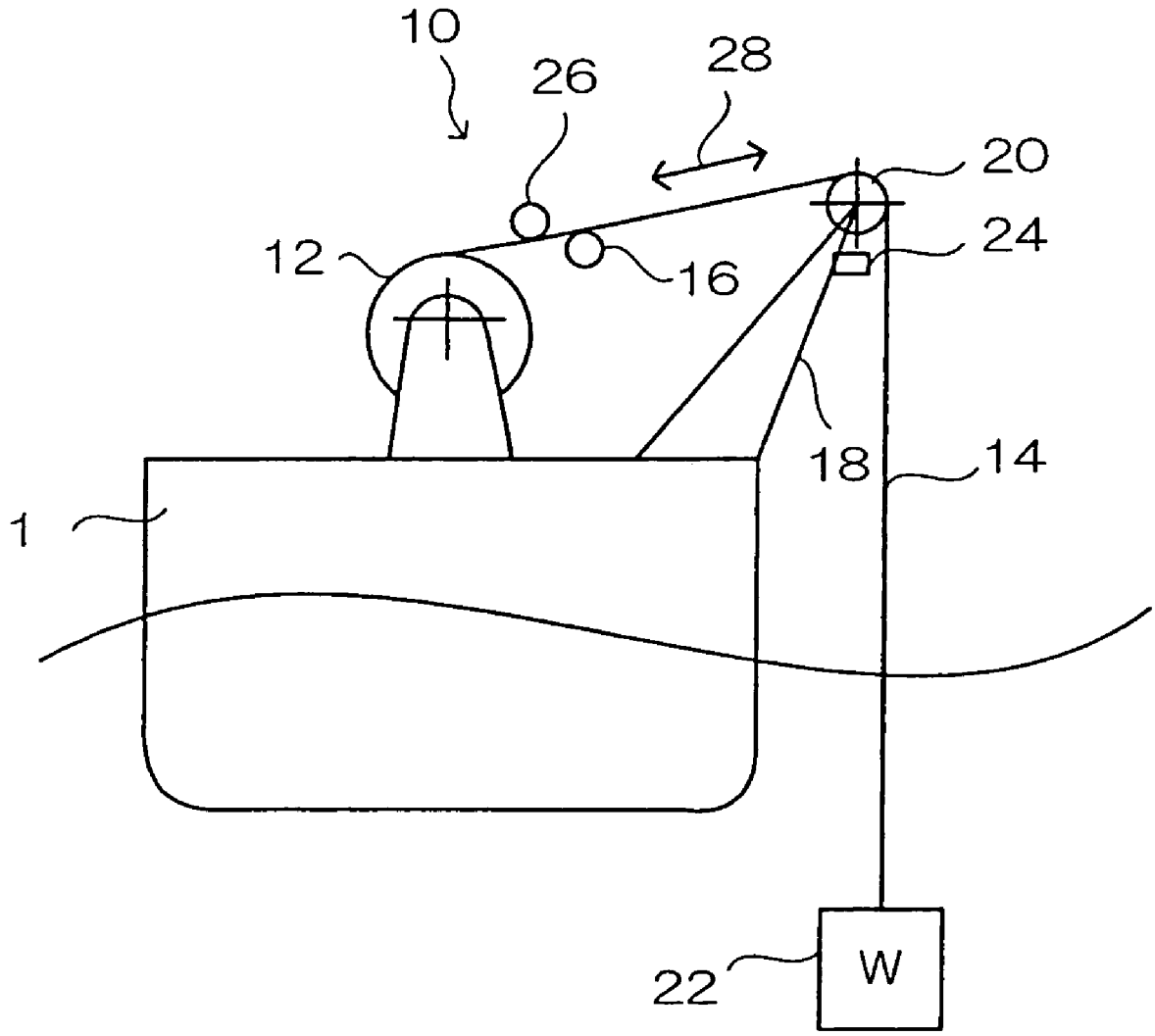
FIG. 2 is a schematic explanatory view of the hoisting device with the vertical motion compensation function according to embodiments of the present invention.

FIG. 1 and FIG. 2 are explanatory drawings of a hoisting device with a vertical motion compensation function according to a first embodiment the present invention. In FIG. 2, a hoisting device 10 has a drum 12 disposed on a deck of a hull 1, constituting the hoisting device. The drum 12 can freely rotates, and can roll up or pay out a wire 14 wound thereon. A tip of the wire 14 hangs from a pulley 20, guided by the pulley 20 installed at a tip of a boom 18 through a guide roller 16 so as to be freely rotatable. And an equipment 22 such as a CTD measuring instrument is hung at the tip of the wire 14. An acceleration sensor 24 as being a vertical motion sensor is provided at the same position as the pulley 20, which is to be a hanging point of the wire 14. The acceleration sensor detects a vertical motion of the pulley 20 accompanied by the vertical motion (heaving) of the hull caused by waves, and inputs a detected signal to a control unit described later.

Furthermore, a wire speed sensor 26 composed of a rotary encoder and so on is provided between the drum 12 and the pulley 20. When the drum 12 pays out or rolls up the wire 14 in the direction of an arrow 28, rotating in normal or reverse direction, the wire speed sensor 26 detects a paying-out speed or a rolling-up speed of the wire 14 and inputs it to the control unit. Note that the boom 18 can be a fixed boom provided fixedly on the deck or a movable boom of which tip swings in up and down directions.

The hoisting device 10 includes a hoist 30 paying out and rolling up the wire 14 and a control unit 32 controlling the hoist 30 as shown in FIG. 1. The control unit 32 includes an acceleration/displacement transducer 34 finding the moving speed and the moving displacement, a first adder 36 finding the difference between a speed instruction and the detected signal, a second adder 38 finding the difference between an output signal of the first adder 36 and a displacement signal, and a servo amplifier 40 drive-controlling the hoist 30 based on an output signal of the second adder. The acceleration/displacement transducer 34 can find vertical moving direction, the moving speed and the moving displacement of the pulley 20 by integrating acceleration detected signal outputted by the acceleration sensor 24, and feeds them as a feedback signal Af to the second adder 38.

A speed instruction Vi of the paying-out speed or the rolling-up speed of the wire 14 is inputted to the first adder 36. Also, a detected signal Vf of the wire speed sensor 26 is inputted to the first adder 36 as the feedback signal. The first adder 36 calculates the difference between Vi and Vf to input the difference to the second adder 38. The second adder 38 calculates the difference between the output signal of the first adder 36 and the moving displacement signal Af of the vertical motion of the pulley 20 outputted by the acceleration/displacement transducer 34, and outputs the difference to the servo amplifier 40. The servo amplifier 40 outputs a drive control signal of the hoist 30 so as to obtain the speed instruction Vi. In addition, there exists another way of feeding back a moving speed signal or a moving acceleration signal instead of feeding back the displacement signal.

On the other hand, the hoist 30 has a drum 12 on which the wire 14 winds, an oil pressure pump (hydraulic motor) 42 directly connecting to the drum 12 and rotating the drum 12 in normal and reverse directions, a two-way discharge fixed capacity type oil pressure pump 44 as a hydraulic pump supplying operating oil to the oil pressure motor 42, and a servomotor 46 rotating the oil pressure pump 44 as main components. The servomotor 46 can rotate in normal and reverse directions, and a discharge direction and a discharge amount of the operating oil of the oil pressure pump 44 change as a rotational direction and a rotational speed of the servomotor 46 change. In the oil pressure pump 44, one discharge port is directly connected to one flow-in port of the oil pressure motor 42 through a pipeline 48, and the other discharge port thereof is directly connected to the other flow-in port of the oil pressure motor 42 through a pipeline 50. The oil pressure pump 44, the oil pressure motor 42 and the pipelines 48, 50 form a closed circuit. The servomotor 46 is connected to a motor drive circuit 47, which controls the rotational direction and rotational speed of the servomotor 46 based on the output signal of the servo amplifier.

A supply pipeline 52 is provided between the pipeline 48 and the pipeline 50. A pair of check valves is arranged facing each other to the supply pipeline 52. A branch pipeline 58 branches between the check valves 54, 56, and an oil tank is connected at an end of the branch pipeline 58. The check valves 54, 56 are valves for compensating a drain flow amount by an internal leakage of the oil pressure pump 44 and the oil pressure motor 42. When the operating oil is supplied from the oil pressure pump 44 to the oil pressure motor 42 through the pipeline 48, the operating oil of a return side becomes short in supply by the internal leakage. Then, the pipeline 50 becomes a negative pressure state, and the shortfall of operating oil is supplied from the tank 60 by opening a valve of the check valve 56. The oil pressure pump 44 and the oil pressure motor 42 compose a speed reducer having a fixed speed reduction ratio.

The hoisting device 10 of the first embodiment thus constituted, when the hull 1 moves in up and down directions by waves (heaving), accordingly the pulley 20 provided at the tip of the boom 18 moves vertically. The control of maintaining the equipment 22 hung by the wire 14 in a constant depth is performed as follows.

The speed instruction Vi=0 (zero) is inputted to the first adder 36 of the control unit 32 in order to maintain the equipment 22 in a constant depth. The acceleration sensor 24 provided at the tip portion of the boom 18 detects the acceleration of the vertical motion of the pulley 20 as the hanging point of the wire 14 and inputs the detected signal to the acceleration/displacement transducer 34. The acceleration/displacement transducer 34 finds the moving direction and moving speed of the vertical motion of the pulley 20 and output them as the feedback signal Af to the second adder 38. The second adder 38 finds the difference between the output signal of the first adder 36 and the feedback signal Af outputted by the acceleration/displacement transducer 34 and feeds it to the servo amplifier 40. The servo amplifier 40 outputs the control signal to the motor drive circuit 47, which corresponds to the paying-out speed or the rolling-up speed of the wire 14 that can offset the vertical motion of the pulley 20. Namely, the servo amplifier 40 outputs the control signal to the motor drive circuit 47, which can pay out the wire 14 at a speed corresponding to the moving speed when the pulley moves upward, for example.

The motor drive circuit 47 controls the discharge direction and the discharge amount of the operating oil of the oil pressure pump 44 in accordance with the output signal of the servo amplifier 40 so that the oil pressure motor 42 is allowed to rotate in the normal direction, for example. Accordingly, the operating oil is supplied to the oil pressure motor 42 and the oil pressure motor 42 rotates in the normal direction to rotate the drum 12. The wire 14 is paid out at the speed approximately in proportion to the rotational speed of the drum 12. The wire speed sensor 26 detects the paying-out speed Vf of the wire and inputs it to the first adder 36 of the control unit 32 as the feedback signal. Then, as described above, the second adder 38 outputs double feedback signals to the servo amplifier 40, based on the output signals of the first adder 36 and the acceleration/displacement transducer 34. The servo amplifier 40 outputs the drive control signal of the servomotor 46 so that the speed detected signal Vf of the wire speed sensor 26 corresponds to the speed found by the acceleration/displacement transducer 34. Therefore, the effects of the vertical motion of the pulley 20 operating on the equipment 22 hung by the wire 14 are eliminated, as a result, Vi=0 (zero), namely, the equipment 22 is maintained in a constant depth. When the tip of the boom 18 (pulley 20) moves downward, the hoisting control of the wire 14 is performed in the same way, the equipment 22 hung by the wire 14 is maintained in the set-up specified depth.

In general, the rotational speed of the servomotor 46 as an electric motor is approximately 1500 to 2000 rpm and is much larger than the rotational speed of the drum 12, therefore, it is required to be reduced. Thus, for example, when the discharge amount of the operating oil per rotation of the oil pressure pump 44 is 10 ml and the required amount of the operating oil per rotation of the oil pressure motor 42 is 200 ml, a speed reduction ratio becomes 20:1, resultingly, an output torque of the oil pressure motor 42 can be increased.

Accordingly, even if the pulley 20 is moved vertically by waves or the like, the effects thereof are eliminated and the equipment 22 hung by the wire 14 is maintained in a constant depth. Additionally, since the hoisting device 10 of the embodiment does not operate a large structure such as a crane boom, it can be small-sized. And the energy consumption of the hoisting device 10 can be also reduced. Furthermore, the hoisting device 10 can improve the response speed by paying out and rolling up the wire 14 rapidly. As a result, the CTD measurement and the like can be performed more accurately and more rapidly.

On the other hand, for example, when the equipment 22 is allowed to be lowered at a constant speed $V_0$ with the wire 14 payed out, "Vi=0 (zero)" is given to the first adder 36 of the control unit 32. The wire speed sensor 26 detects the pulling-out speed Vf of the wire 14 and input it to the first adder 36. The first adder 36 calculates "$V_0$-Vf" and inputs the result to the second adder 38. The second adder 38 calculates the difference between the output signal of the first adder 36 and the feedback signal Af of the moving direction and moving displacement of the pulley 20 calculated from the detected signal of the acceleration sensor 24 by the acceleration/displacement transducer 34, and inputs the result to the servo amplifier 40. Note that there exists another way of feeding back the moving speed signal or the moving acceleration signal, instead of feeding back the displacement signal. The servo amplifier 40 gives the control signal to the motor drive circuit 47, which corresponds to the rotational direction and rotational speed of the servomotor 46 in which the pulling-out speed V of the wire 14 whereby the descending speed of the equipment 22 becomes $V_0$ can be obtained. Therefore, when the pulley 20 moves upward by waves, for example, the servomotor 46 is driven so that the pulling-out speed of the wire 14 becomes larger than $V_0$. When the pulley 20 moves downward, the servomotor 46 is driven so that the pulling-out speed becomes smaller than $V_0$. As a result, the hoisting device 10 can maintain the descending speed of the equipment 22 hung by the wire 14 at the prescribed $V_0$. When the equipment 22 is pulling up at a constant speed, the control is also performed in the same way. A paying-out amount and a rolling-up amount of the wire 14 can be found by integrating the output signal of the wire speed sensor 26. Alternatively, after the length of the wire 14 is measured and converted the measured value to the speed signal, the signal can be added to the first adder 36.

In the first embodiment described above, the case that the acceleration sensor 24 is used for detecting the vertical motion of the pulley 20 as the hanging point of the wire 14 is described, however, the detection of the vertical motion of the pulley 20 can be performed by any other method that can detect the vertical motion, such as the global positioning system (GPS) or a gyroscope. Also in the aforementioned embodiment, the case that the oil pressure pump 44 is the fixed capacity type is described, however, the oil pressure pump 44 can be a variable capacity type pump. Thus, the speed reduction ratio of the speed reducer composed of the oil pressure pump and the oil pressure motor can be variable. In addition, it is preferable that the discharge direction of the operating oil of the oil pressure pump is allowed to be one direction and switches the supply of the operating oil to the oil pressure motor 42 by a three-way valve and the like to rotate the oil pressure motor 42 in normal and reverse directions. Furthermore, the equipment 22 hung by the wire 14 can be a work robot or a television camera.

Figure 3:
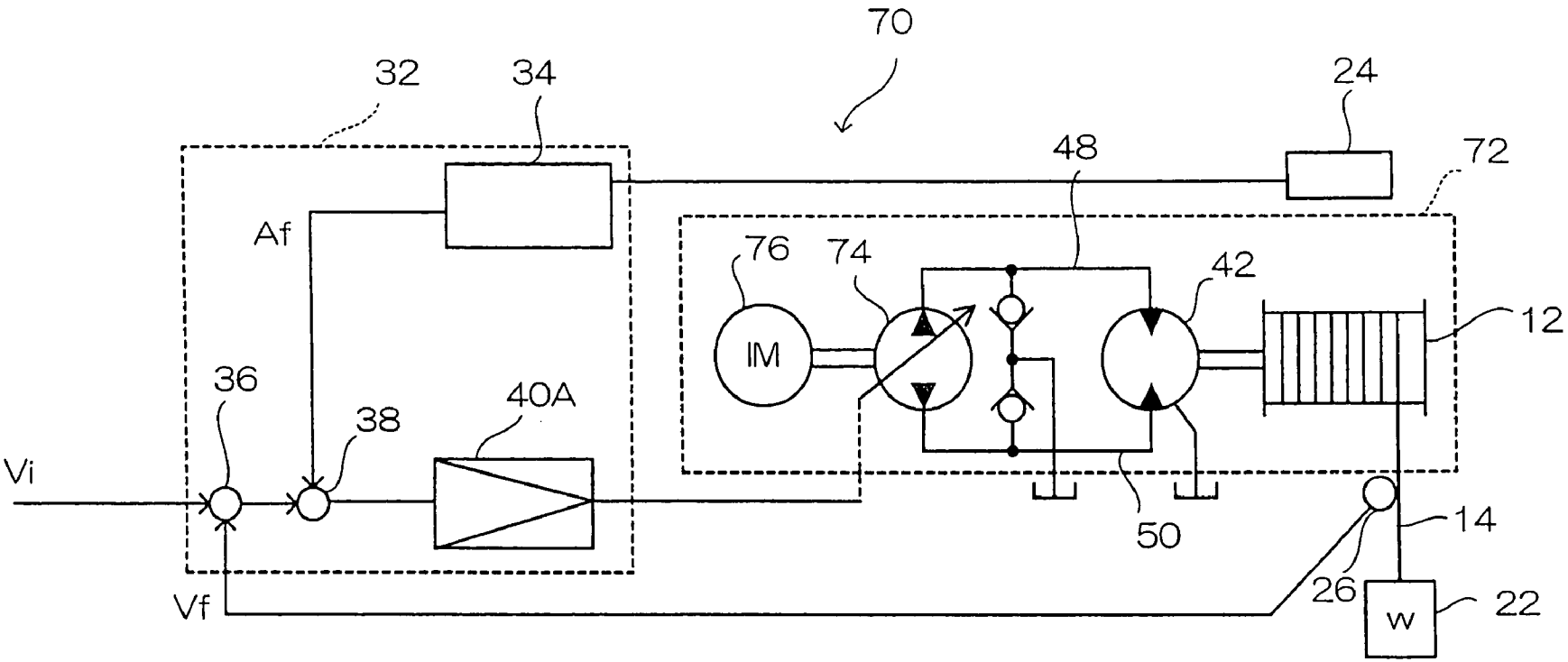
FIG. 3 is a detailed explanatory diagram of a hoisting device with a vertical motion compensation function according to a second embodiment of the present invention.
Figure 4:
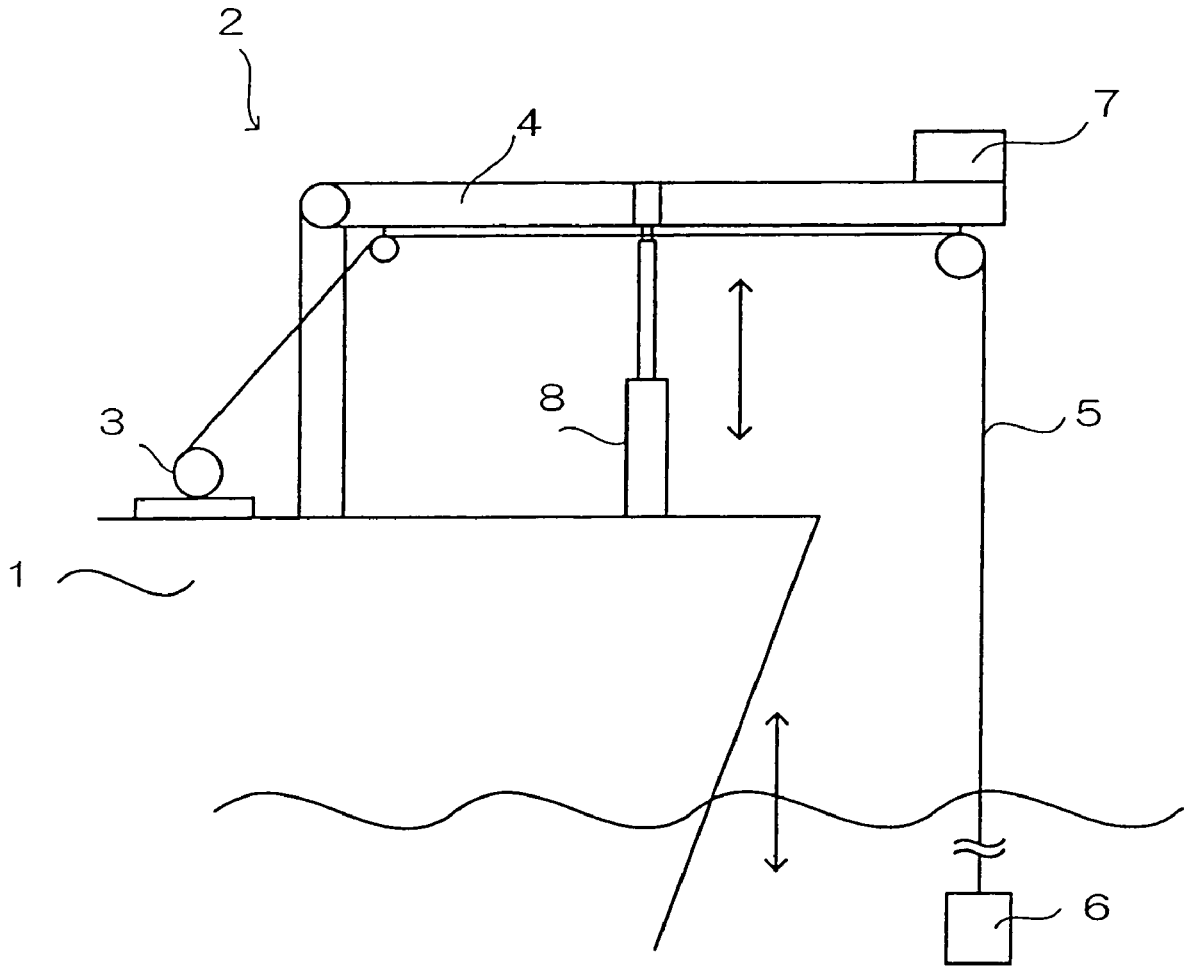
FIG. 4 is a schematic explanatory view of a conventional heaving-compensation crane.

FIG. 3 is an explanatory view of a second embodiment. In a hoisting device 70 according to the second embodiment, a structure of a hoist is different from the hoist 30 shown in FIG. 1. Namely, in a hoist 72 of the second embodiment, a hydraulic pump is constituted by a two-way discharge variable capacity type oil pressure pump 74, and an electric motor is constituted by a general-purpose induction motor 76 rotating constantly in one direction in a constant rotational speed. The two-way discharge variable capacity type oil pressure pump 74 is a swash-plate pump in this embodiment, connected to a pump control unit not shown. The pump control unit controls an inclination direction and an inclination angle of the swash plate, and controls a discharge direction and a discharge amount of operating oil of the swash-plate pump 74, based on an output signal of a servo amplifier 40A of a control unit 32. The swash-plate pump 74 and a oil pressure motor 42 are directly connected by pipelines 48, 50, constituting a speed reducer having a variable speed reduction ratio, that is, a continuously variable transmission.

In the hoisting device 70 of the second embodiment thus constructed, the induction motor 76 rotates constantly in one direction at a constant rotational speed to rotate the swash-plate pump 74 in one direction at a constant rotational speed. The servo amplifier 40A of the control unit 32 outputs a signal to the swash-plate pump 74 so that a required paying-out speed or a rolling-up speed of the wire 14 can be obtained, based on an output signal of a second adder 38. The output signal of the servo amplifier 40A is given to the pump control unit. The pump control unit controls an inclination direction and an inclination angle of the swash-plate of the swash-plate pump 74. Accordingly, operating oil is supplied from the swash-plate pump 74 to the oil pressure motor 42, which rotates in normal direction and in reverse direction. Then, the hoisting device 70 pays out and rolls up the wire 14 so that the vertical motion of a pulley 20 caused by the heaving of a hull 1 can be offset. Therefore, also in the hoisting device 70 of the second embodiment, the same operation and effect as the aforementioned embodiment can be obtained. In addition, in the second embodiment, the discharge direction and the discharge amount of the operating oil can be changed by the inclination direction and the inclination angle of the swash plate of the swash-plate pump 74, as a result, the electric motor can be small-sized.

As described above, according to the present invention, the wire is payed out or rolled up in accordance with the heaving of the hull, as a result, the device can be small-sized and the energy consumption can be saved.

NUMERALS

1 HULL
10,70 HOISTING DEVICE WITH A VERTICAL MOTION COMPENSATION FUNCTION (HOISTING DEVICE)
12 DRUM
14 WIRE
20 WIRE HANGING POINT (PULLEY)
22 EQUIPMENT
24 VERTICAL MOTION SENSOR (ACCELERATION SENSOR)
26 WIRE SPEED SENSOR
30,72 HOIST
32 CONTROL UNIT
42 HYDRAULIC MOTOR (OIL PRESSURE MOTOR)
44,72 HYDRAULIC PUMP (TWO-WAY DISCHARGE FIXED CAPACITY TYPE OIL PRESSURE PUMP, TWO-WAY DISCHARGE VARIABLE CAPACITY TYPE OIL PRESSURE PUMP)
46,76 ELECTRIC MOTOR (SERVOMOTOR, INDUCTION MOTOR)
47 MOTOR DRIVE CIRCUIT

What is claimed is:

1. A method for maintaining a constant vertical velocity for an under-water device hung from a hoist on a ship, the method comprising:

detecting a speed of a wire hung from a hanging point of the hoist and connected to the underwater device, wherein the hanging point of the wire is a point from which the wire hangs;

detecting a vertical motion of the hanging point of the wire, the vertical motion being caused by a vertical motion of the ship; and paying out or rolling up the wire by controlling a discharge amount of a hydraulic pump that controls a winding of the wire based on the detected speed and the detected vertical motion to eliminate effects of the vertical motion of the hanging point operating on the wire and maintain the constant vertical velocity of the under-water device.

2. The method according to claim 1, wherein the discharge amount of the hydraulic pump is based on the detected vertical motion and the detected speed to maintain a given paying-out speed or a rolling up speed of the wire.

3. The method according to claim 1, wherein:

a hydraulic motor rotates a drum which winds the wire and is rotatable in normal and reverse directions;

the hydraulic pump is directly connected and supplies operating oil to the hydraulic motor; and an electric motor rotationally drives the hydraulic pump.

4. A method for maintaining a constant vertical velocity for an under-water device hung from a hoist on a ship, the method comprising:

detecting a speed of a wire hung from a hanging point of the hoist and connected to the underwater device, wherein the hanging point of the wire is a point from which the wire hangs;

detecting a vertical motion of the hanging point of the wire, the vertical motion being caused by a vertical motion of the ship; and paying out or rolling up the wire by controlling a discharge amount and a discharge direction of operating oil of a two-way discharge fixed capacity type pump that controls a winding of the wire based on the detected vertical motion and the detected speed to eliminate effects of the vertical motion of the hanging point operating on the wire and maintain the constant vertical velocity of the under-water device.

5. The method according to claim 4, wherein the discharge amount and discharge direction of the two-way discharge fixed capacity type pump is based on the detected vertical motion and the detected speed to maintain a given paying-out speed or rolling-up speed of the wire.

6. The method according to claim 4, wherein:

a hydraulic motor rotates a drum which winds the wire and is rotatable in normal and reverse directions;

the two-way discharge fixed capacity type pump supplies operating oil to the hydraulic motor; and a servomotor rotationally drives the two-way discharge fixed capacity type pump in normal and reverse directions.

7. A method for maintaining a constant vertical velocity for an under-water device hung from a hoist on a ship, the method comprising:

detecting a speed of a wire hung from a hanging point of the hoist and connected to the underwater device, wherein the hanging point of the wire is a point from which the wire hangs;

detecting a vertical motion of the hanging point of the wire, the vertical motion being caused by a vertical motion of the ship; and paying out or rolling up the wire by controlling a discharge amount and a discharge direction of operating oil of a two-way discharge variable capacity type pump that controls a winding of the wire based on the detected vertical motion and the detected speed to eliminate effects of the vertical motion of the hanging point operating on the wire and maintain the constant vertical velocity of the under-water device.

8. The method according to claim 7, wherein the discharge amount of the two-way discharge variable capacity type pump is based on the detected vertical motion and the detected speed to maintain a given paying-out speed or a rolling-up speed of the wire.

9. The method according to claim 8, wherein the two-way discharge variable capacity type pump controls the discharge amount of the operating oil depending on an inclination direction and an inclination angle of a swash-plate.

10. The method according to claim 7, wherein:

a hydraulic motor rotates a drum which winds the wire and is rotatable in normal and reverse directions;

the two-way discharge variable capacity type pump supplies operating oil to the hydraulic motor; and an electric motor rotationally drives the two-way discharge variable capacity type pump.

11. The method according to claim 7, wherein the two-way discharge variable capacity type pump controls the discharge amount of the operating oil depending on an inclination direction and an inclination angle of a swash-plate.

* * * * *